US007497747B2

(12) United States Patent
Kado et al.

(10) Patent No.: US 7,497,747 B2
(45) **Date of Patent: *Mar. 3, 2009**

(54) CONTROL SYSTEM FOR PROPULSION UNIT

(75) Inventors: Takuya Kado, Shizuoka-ken (JP); Shu Akuzawa, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/966,100

(22) Filed: Dec. 28, 2007

(65) Prior Publication Data

US 2008/0171480 A1 Jul. 17, 2008

(30) Foreign Application Priority Data

Dec. 28, 2006 (JP) ..... 2006-355327

(51) Int. Cl.
*B63H 21/22* (2006.01)

(52) U.S. Cl. ..... 440/1; 440/84

(58) Field of Classification Search ..... 440/1, 440/84, 86, 85

See application file for complete search history.

(56) References Cited

U.S. PATENT DOCUMENTS 6,856,882 B2 * 2/2005 Raab ..... 701/70
7,153,174 B2 12/2006 Takada et al.

FOREIGN PATENT DOCUMENTS

JP 08-200110 8/1996
JP 2000-313398 11/2000

OTHER PUBLICATIONS

U.S. Appl. No. 11/966,984, filed Dec. 28, 2007, entitled Propulsion Unit Control System.
U.S. Appl. No. 12/020,499, filed Jan. 25, 2008, entitled Control Device for Plural Propulsion Units.
U.S. Appl. No. 11/971,860, filed Jan. 9, 2008, entitled Control Device for Plural Propulsion Units.

* cited by examiner

*Primary Examiner*—Stephen Avila
(74) *Attorney, Agent, or Firm*—Knobbe, Martens, Olson & Bear, LLP

(57) ABSTRACT

A propulsion unit control system is provided for a boat having plural propulsion units provided side by side and electrically connected in association with two adjacent operation levers. The control system synchronizes engine speeds of the respective propulsion units with each other based at least in part on the position of the two operation levers. The control system determines whether certain factors are satisfied before synchronizing engine speeds. The factors include, for example, whether a deviation in angular position between the two operation levers is within a prescribed range. Another factor is whether a deviation between the throttle opening of a reference propulsion unit and a propulsion unit to be synchronized equal to or less than a prescribed value. If the respective deviations are equal to or smaller than a relevant prescribed value, the engine speeds of the respective propulsion units are controlled for synchronization with each other.

15 Claims, 8 Drawing Sheets

CONTROL SYSTEM FOR PROPULSION UNIT

CROSS-REFERENCE TO RELATED APPLICATIONS

The present application is based on and claims priority under 35 U.S.C. § 119 to Japanese Patent Application Serial No. 2006-355327, filed on Dec. 28, 2006, the entire contents of which are expressly incorporated by reference herein.

BACKGROUND OF THE INVENTION

1. Field of the Invention

The present invention relates to a control system for a boat having plural propulsion units provided side by side, which synchronizes engine speeds of the respective propulsion units with each other.

2. Description of the Related Art

One conventional boat has three propulsion units, such as outboard motors, stern drives or inboard-outdrive arrangements, provided side by side at its stern. In this type of boat, there typically are provided three shift/throttle lever pairs associated with corresponding ones of the individual propulsion units. Operating the six levers in addition to a steering wheel is cumbersome and can be troublesome to the operator.

To address this issue, one recently proposed control system uses two adjacent left and right operation levers to control shift and throttle operations of all of the plural propulsion units. With the operation levers tilted at equal angles, if the engines of the left and right propulsion units rotate at different speeds, a motor of a throttle actuating unit is actuated so as to equalize the engine speeds of the left and right propulsion units with respect to the engine speed of the right propulsion unit. As such, the engine speeds of the left and right propulsion units are synchronized with each other automatically (See Japanese Publication No. JP-A-2000-313398).

As described above, with the left and right operation levers tilted at equal angles, the control system synchronizes the engine speeds of the respective propulsion units with each other. However, there are circumstances in which the left and right operation levers are operated differently and are tilted at different angles. For example, when the boat turns left or right, the left and right operation levers are operated in opposed directions, and the operation levers thus are not tilted at equal angles. No control systems have been contemplated that synchronize the engine speeds of the respective propulsion units with each other in consideration of such an operating environment and operation conditions.

SUMMARY

Accordingly, there is a need in the art for a propulsion unit control system for controlling the engine speeds of the respective propulsion units for synchronization with an operator's desired engine speed in consideration of variable operating environment and operating conditions.

In accordance with a preferred embodiment, the present invention provides a propulsion unit control system for a boat having plural propulsion units provided side by side and electrically connected in association with two adjacent operation levers that are controllable by an operator to operate a shift actuator and a throttle actuator of a corresponding one of the propulsion units. The control system comprises a lever position detecting device configured to detect a lever position of the operation lever associated with a reference propulsion unit and a lever position of the operation lever associated with a propulsion unit to be synchronized. A throttle opening detecting device is configured to detect a throttle opening of the reference propulsion unit and a throttle opening of the propulsion unit to be synchronized. A control device is configured to control the engine speeds of the respective propulsion units for synchronization with each other when certain determining conditions are met. The control device is configured to compute a deviation between the lever position of the operation lever of the reference propulsion unit and the lever position of the operation lever of the propulsion unit to be synchronized and to compare the computed lever deviation to a prescribed value. The control device is further configured to compute a deviation between the throttle opening of the reference propulsion unit and the throttle opening of the propulsion unit to be synchronized and to compare the computed throttle opening deviation to a prescribed value. The control device is further configured to control the engine speeds of the propulsion units for synchronization with each other if the computed lever deviation and the computed throttle opening deviation are each equal to or smaller than their respective prescribed values.

In accordance with another embodiment, the control device is configured to define an engine speed of any one of the propulsion units as a determining condition. If the engine speed is equal to or lower than a maximum engine speed, the control device controls the engine speeds of the respective propulsion units for synchronization with each other.

In yet another embodiment, the control device is configured to define an engine speed of any one of the propulsion units as a determining condition. If the engine speed is equal to or higher than a minimum engine speed, the control device controls the engine speeds of the respective propulsion units for synchronization with each other.

In still another embodiment, an engine anomaly detecting device is configured to detect an engine abnormal condition of the respective propulsion units. The control device is configured to perform alert control based on detection of the engine abnormal condition. The presence or absence of the alert control is a determining condition so that, if the alert control is performed, the control device will not control the engine speeds of the respective propulsion units for synchronization with each other.

In a further embodiment, a failure detecting device is provided for detecting a failure of the boat or the respective propulsion units. The control device is configured to perform protection control based on detection of the failure. The presence or absence of the protection control is a determining condition so that, if no protection control is performed, the control device will control the engine speeds of the respective propulsion units for synchronization with each other.

In a yet further embodiment, a shift position detecting device is configured to detect a shift position of the operation lever of the reference propulsion unit and a shift position of the operation lever of the propulsion unit to be synchronized. Whether the shift position of the operation lever of the reference propulsion unit and the shift position of the operation lever of the propulsion unit to be synchronized correspond with each other is a determining condition. The control device is configured so that if the shift positions correspond with each other, the control device will control the engine speeds of the respective propulsion units for synchronization with each other.

In a still further embodiment, the control device defines a prescribed time, and the control device is configured so that if the determining conditions are maintained for the prescribed time, the control device will control the engine speeds of the respective propulsion units for synchronization with each other.

In yet a further embodiment, the control device is configured to be actuated when the operation lever is placed at a prescribed position or a further position.

In accordance with another embodiment, a method is provided for controlling a plurality of propulsion units that are mounted side by side on a boat and are electrically connected with two adjacent operation levers that are controllable by an operator to operate a shift actuator and a throttle actuator of a corresponding one of the propulsion units. The method comprises providing a lever position detecting device, detecting a lever position of the operation lever associated with a reference propulsion unit, detecting a lever position of the operation lever associated with a propulsion unit to be synchronized, providing a throttle opening detecting device, detecting a throttle opening of the reference propulsion unit, detecting a throttle opening of the propulsion unit to be synchronized, providing a control device configured to selectively control the engine speeds of the respective propulsion units for synchronization with each other, determining whether at least a first and a second determining condition are met, and controlling the engine speeds of the propulsion units for synchronization with each other if the control device determines that the determining conditions are met. Determining whether the first determining condition is met comprises computing a deviation between the lever position of the operation lever of the reference propulsion unit and the lever position of the operation lever of the propulsion unit to be synchronized and comparing the computed lever deviation to a prescribed value. If the computed lever deviation is equal to or less than the prescribed value the first determining condition is met. Determining whether the second determining condition is met comprises computing a deviation between the throttle opening of the reference propulsion unit and the throttle opening of the propulsion unit to be synchronized and comparing the computed throttle opening deviation to a prescribed value. If computed throttle opening deviation is equal to or less than the associated prescribed value then the second determining condition is met.

DETAILED DESCRIPTION OF PREFERRED EMBODIMENTS

Description will now be made of embodiments of a propulsion unit control system having features in accordance with the present invention. It should be understood that the disclosed embodiments present examples in connection with one or more preferred embodiments, and the scope of the present invention is not limited to the embodiments disclosed herein.

Figure 1:
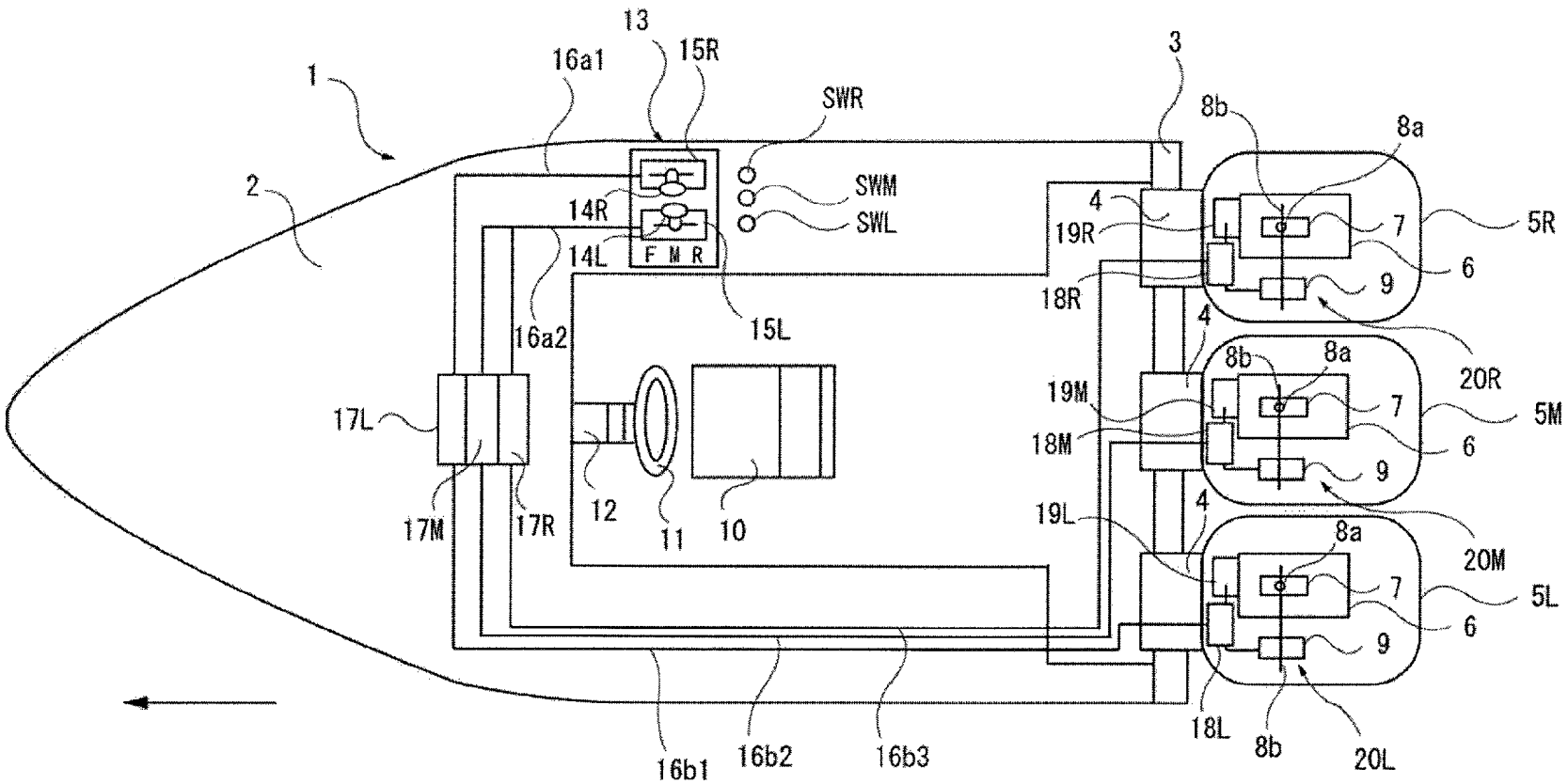
FIG. 1 is a schematic plan view of a boat having a propulsion unit control system.
Figure 2:
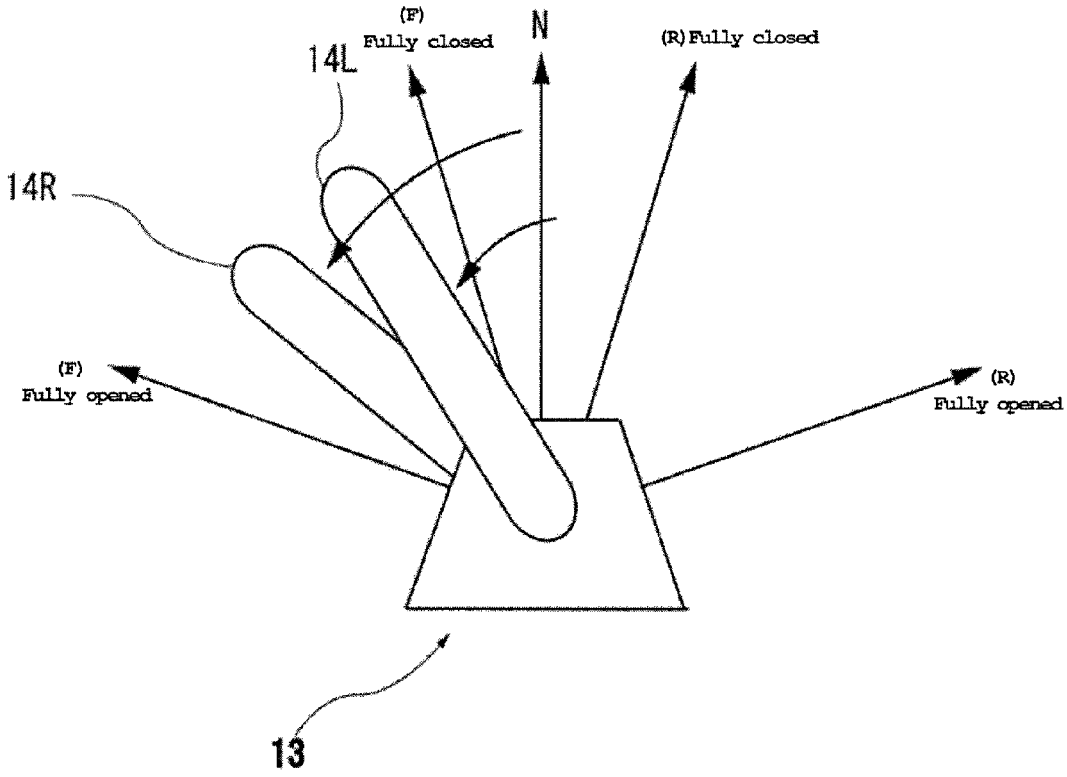
FIG. 2 illustrates an embodiment of a remote controller.

FIG. 1 is a schematic plan view of a boat with a propulsion unit control system according to a preferred embodiment. FIG. 2 illustrates a remote controller. In this embodiment, a boat hull is equipped with three propulsion units. In other embodiments, it may be equipped with two, four or more propulsion units.

As shown, a boat 1 includes a hull 2 and three propulsion units 5L, 5M, 5R. The propulsion units 5L, 5M, 5R are mounted to a transom 3 of the hull 2 via a clamp bracket 4. In this embodiment, the propulsion unit is an outboard motor. In other embodiments, the propulsion unit may be, for example, a stern drive or an inboard-outdrive engine. For the illustrative purpose, with respect to the forward direction indicated by arrow in FIG. 1, the propulsion unit on the left, the propulsion unit on the right, and the propulsion unit in the middle are hereinafter respectively referred to as left propulsion unit 5L, right propulsion unit 5R, and middle propulsion unit 5M. In the boat with two propulsion units for example, the left propulsion unit is referred to as left propulsion unit 5L, and the right propulsion unit as right propulsion unit 5R. In the boat with four propulsion units, for example, the leftmost propulsion unit is referred to as left propulsion unit 5L, the rightmost propulsion unit as right propulsion unit 5R, and the other two propulsion units in the middle as middle propulsion units 5M. The same applies in a boat with five propulsion units.

The propulsion unit 5L, 5M, 5R has an engine 6. In an intake system of the engine 6, a throttle body 7 (or carburetor) is provided to limit the amount of airflow to the engine 6 to control the speed and torque of the engine 6. The throttle body 7 preferably is provided with an electric throttle valve 8*a*. A valve shaft 8*b* of the throttle valve 8*a* is connected to a motor 9. The electric throttle valve 8*a* is designed to be opened or closed by electronically controlling the motor 9 and included in an electrical throttle mechanism 20L, 20M, 20R. In a location of the hull 2 facing an operator's seat 10, a manually operated steering wheel 11 is provided to allow the operator to steer the boat 1. The steering wheel 11 is attached to the hull 2 via a steering wheel shaft 12.

Beside the operator's seat 10, a remote controller 13 preferably is disposed to remotely control the propulsion units 5L, 5M, 5R. The remote controller 13 includes a left remote control lever 14L and a right remote control lever 14R positioned respectively on the left and right with respect to the forward direction. The remote controller 13 preferably also includes lever position sensors 15L, 15R that detect positions of the respective remote control levers 14L, 14R. The lever position sensors 15L, 15R are constituted by potentiometers, for example. In the illustrated embodiment the propulsion units 5L, 5M, 5R are operatively electrically connected to the two adjacent remote control levers 14L, 14R. The remote control levers 14L, 14R allow the operator to control shift actuators and throttle actuators of the propulsion units 5L, 5M, 5R.

More specifically, the operator controls the remote controller 13 through the remote control levers 14L, 14R to control the shifts and the openings of the throttle valves 8*a* of the propulsion units 5L, 5M, 5R, thereby controlling propulsion force of the propulsion units 5L, 5M, 5R, or the speed of the boat 1. The left remote control lever 14L is used to control the shift and the opening of the throttle valve 8*a* (i.e. propulsion force) of the left propulsion unit 5L. The right remote control lever 14R is used to control the shift and the opening of the throttle valve 8*a* (i.e. propulsion force) of the right propulsion unit 5R. The shift and the opening of the throttle valve 8*a* (i.e. propulsion force) of the middle propulsion unit 5M is controlled in accordance with an intermediate position between the left remote control lever 14L and the right remote control lever 14R.

As shown in FIG. 2, with the remote control lever 14L, 14R at a center position, the shift is placed in a neutral (N) mode. When the lever 14L, 14R is tilted forward from the center position, the shift is set to a forward (F) mode. When the lever 14L, 14R is tilted rearward, the shift is set to a reverse (R) mode. With the shift in the forward (F) mode, as the remote control lever 14L, 14R is tilted further forward, the throttle valve 8*a* gradually moves from a fully closed position to a fully open position. With the shift in the reverse (R) mode, as the remote control lever 14L, 14R is tilted further rearward, the throttle valve 8*a* gradually moves from a fully closed position to a fully open position. As such, the operator can control the propulsion forces of the propulsion units 5L, 5M, 5R during both forward running and reverse running by selectively opening and closing the throttle valves 8*a* through the operation of the remote control levers 14L, 14R.

The illustrated remote controller 13 is connected to a remote control unit 17L via a communication cable 16*a*1, while being connected to remote control units 17M, 17R via a communication cable 16*a*2. The remote control units 17L, 17M, 17R receive information on a lever position of the remote control levers 14L, 14R, which is outputted from the lever position sensors 15L, 15R. The remote control units 17L, 17M, 17R then process the information and send it to associated engine control units 18L, 18M, 18R of the three propulsion units 5L, 5M, 5R. The remote control unit 17L and the engine control unit 18L are connected via a communication cable 16*b*1. The remote control units 17M, 17R and the engine control units 18M, 18R are connected via respective communication cables 16*b*2, 16*b*3. In the propulsion units 5L, 5M, 5R, electric shift mechanisms 19L, 19M, 19R associated with the engine 6 are provided to set the shift to a forward mode or a reverse mode. In other embodiments, other structure can be employed to communicate signals between the remote controller 13 and the propulsion units 5L, 5M, 5R.

With continued reference to FIG. 1, beside the operator's seat 10, a main switch SWL, a main switch SWM, and a main switch SWR are provided respectively on the left, in the middle, and on the right in a location proximate to the remote controller 13. The main switches SWL, SWM, SWR are respectively associated with the propulsion units 5L, 5M, 5R. Operating the main switch SWL, SWM, SWR causes the engine 6 of the associated propulsion unit 5L, 5M, 5R to start. In the hull 2, there is provided a steering actuator (not shown) that is operated to turn the associated propulsion unit about its swivel shaft (not shown) in response to an operation angle of the steering wheel 11.

Figure 3:
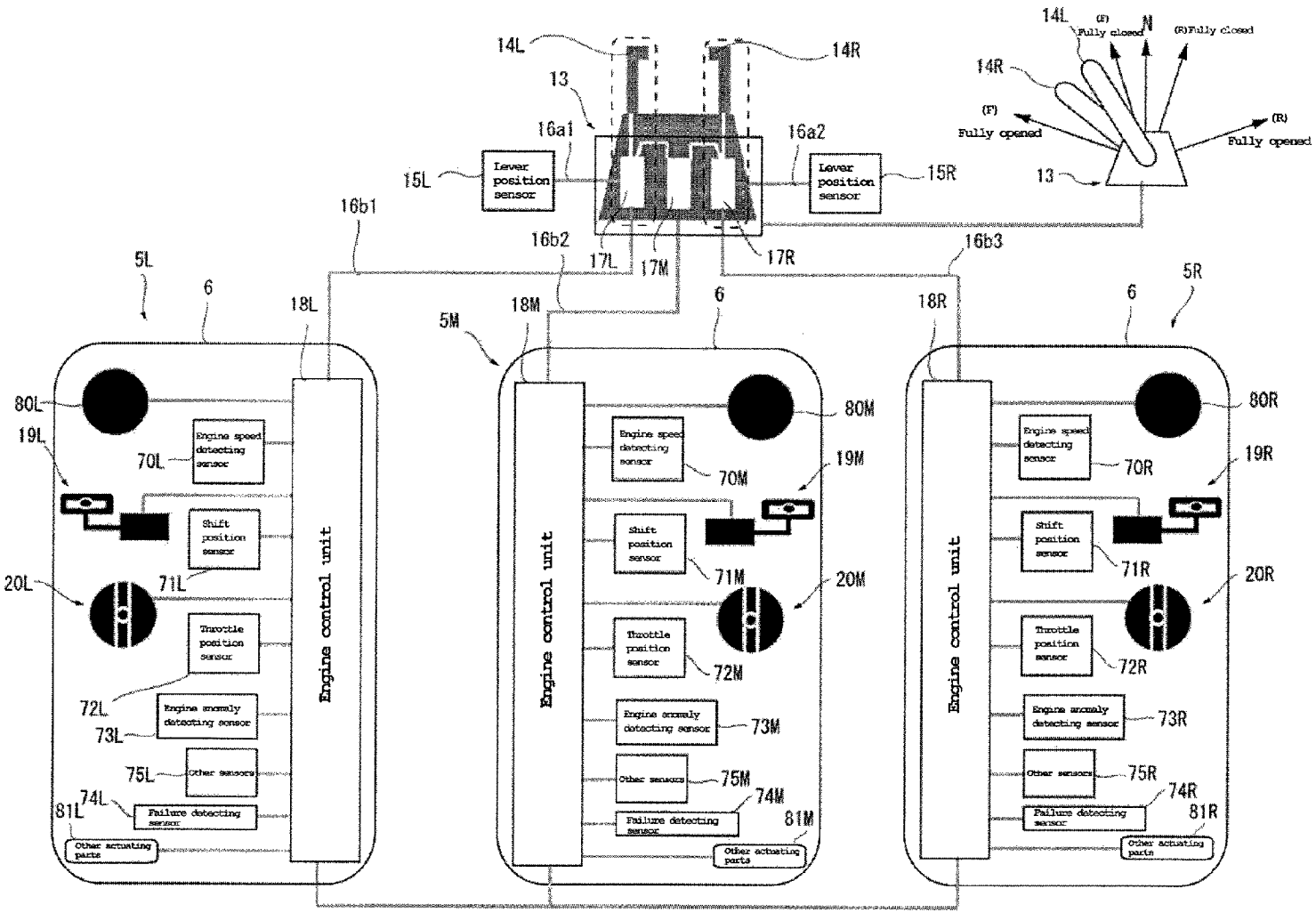
FIG. 3 is a system diagram of a propulsion unit control system in accordance with one embodiment.

FIG. 3 is a system diagram of an embodiment of the propulsion unit control system. The engine control unit 18L included in the left propulsion unit 5L actuates a flywheel 80L, the electric shift mechanism 19L, the electronic throttle mechanism 20L, and other actuating parts 81L. The engine control unit 18L is constituted by an engine control unit (ECU). The other actuating parts 81L include an exhaust cam and an oil control valve. The engine control unit 118L preferably is connected to an engine speed detecting sensor 70L, a shift position sensor 71L, a throttle position sensor 72L, an engine anomaly detecting sensor 73, a failure detecting sensor 74L, and other sensors 75L. Other sensors 75L include an intake air pressure sensor, a camshaft sensor, and a thermo sensor. In this specification, the term "sensor" is intended to be a broad term used in accordance with its ordinary meaning, and including various detectors, whether electronic, mechanical, chemical or functioning in other ways.

When a crankshaft is driven by the engine 6 and rotates, the engine speed detecting sensor 70L obtains information on an engine speed based on the rotations of the flywheel 80L provided around the crankshaft, and inputs the information to the engine control unit 18L. The shift position sensor 71L obtains information on a shift position in a forward, rearward, or neutral mode based on the actuation of the electric shift mechanism 19L, and inputs the information to the engine control unit 18L. The throttle position sensor 72L obtains information on a throttle opening based on the actuation of the electronic throttle mechanism 20L, and inputs the information to the engine control unit 18L. The engine anomaly detecting sensor 73L detects an engine abnormal condition, such as overheating and low engine oil level of the engine 6 of the left propulsion unit 5L. In this embodiment, the failure detecting sensor 74L detects a failure of the remote controller 13 of the boat or failures of the shift actuator and throttle actuator of the left propulsion unit 5L.

The engine control unit 18R included in the right propulsion unit 5R actuates a flywheel 80R, the electric shift mechanism 19R, the electronic throttle mechanism 20R, and other actuating parts 81R. The engine control unit 18R receives information detected by an engine speed detecting sensor 70R, a shift position sensor 71R, a throttle position sensor 72R, an engine anomaly detecting sensor 73R, a failure detecting sensor 74R, and other sensors 75R. In addition, the engine control unit 18M included in the middle propulsion unit 5M actuates a flywheel 80M, the electric shift mechanism 19M, the electronic throttle mechanism 20M, and other actuating parts 81M. The engine control unit 18M receives information detected by an engine speed detecting sensor 70M, a shift position sensor 71M, a throttle position sensor 72M, an engine anomaly detecting sensor 73M, a failure detecting sensor 74M, and other sensors 75M. The engine control units 18R, 18M are both constituted by an engine control unit (ECU) as in the case with the engine control unit 18L. The actuating parts and sensors preferably are also constituted in the same manner as those for the left propulsion unit 5L. The engine control units 18R, 18M and the actuating parts and sensors send/receive the obtained information to/from each other.

The propulsion unit control system is designed to operate the shift actuators and the throttle actuators in order to synchronize the engine speeds of the respective propulsion units with each other in view of the positions of the two remote control levers 14L, 14R. In a preferred embodiment, the engine speed of the left propulsion unit 5L is defined as a reference engine speed to control the engine speeds of the right propulsion unit 5R and the middle propulsion unit 5M for synchronization with the reference engine speed. However, the present invention is not limited to that. For example, in other embodiments the engine speed of the right propulsion unit 5R may be defined as a reference engine speed to control the engine speeds of the left propulsion unit 5L and the middle propulsion unit 5M for synchronization with the reference engine speed. In still other embodiments the engine speed of the middle propulsion unit 5M may be defined as a reference engine speed to control the engine speeds of the left propulsion unit 5L and the right propulsion unit 5R for synchronization with the reference engine speed. Which propulsion unit is defined as a reference or which propulsion units are defined as to be synchronized with the reference preferably is determined when the propulsion unit control system is mounted to the boat.

Figure 4:
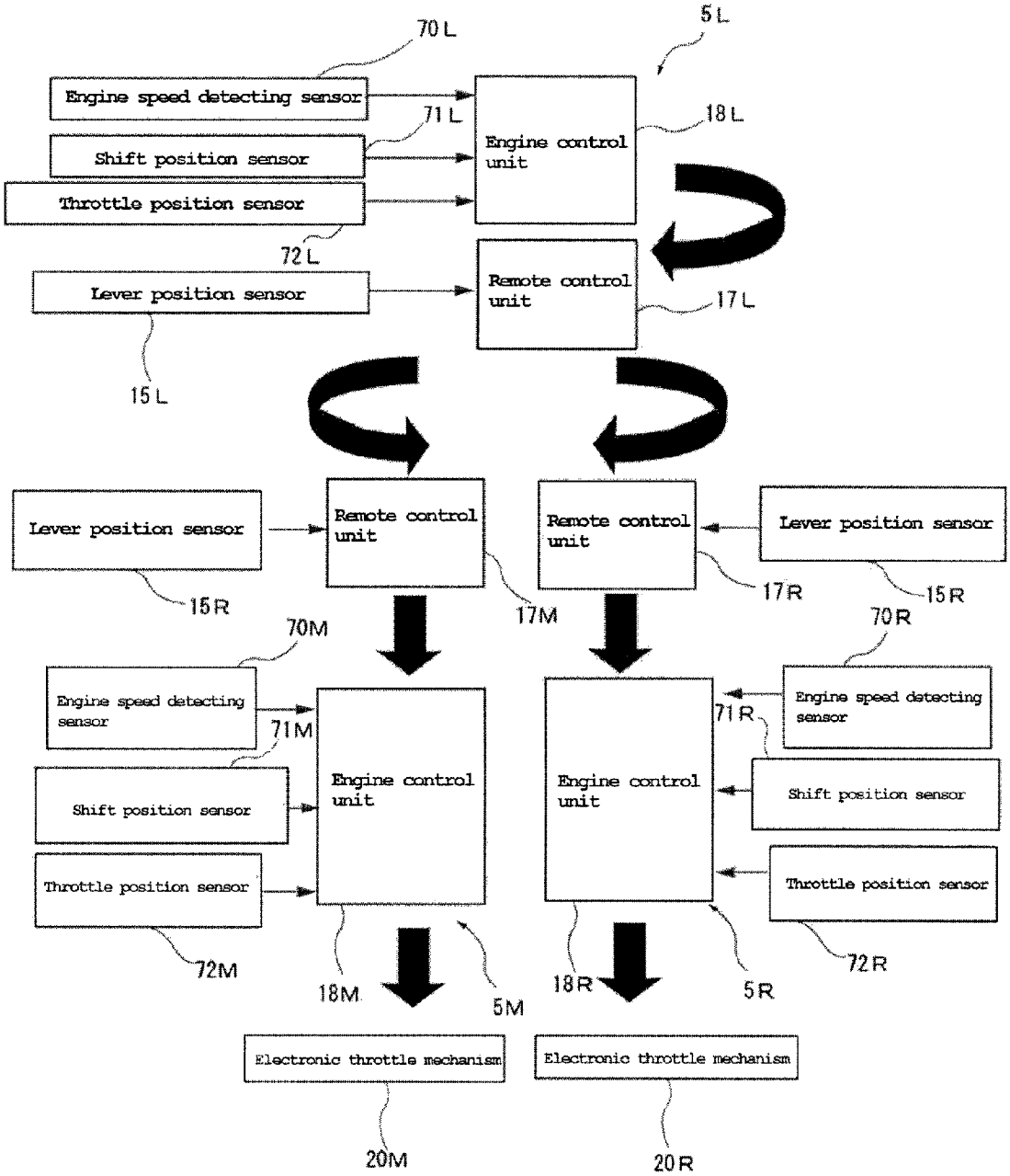
FIG. 4 is a schematic block diagram of a propulsion unit control system as in FIG. 3.
Figure 5:
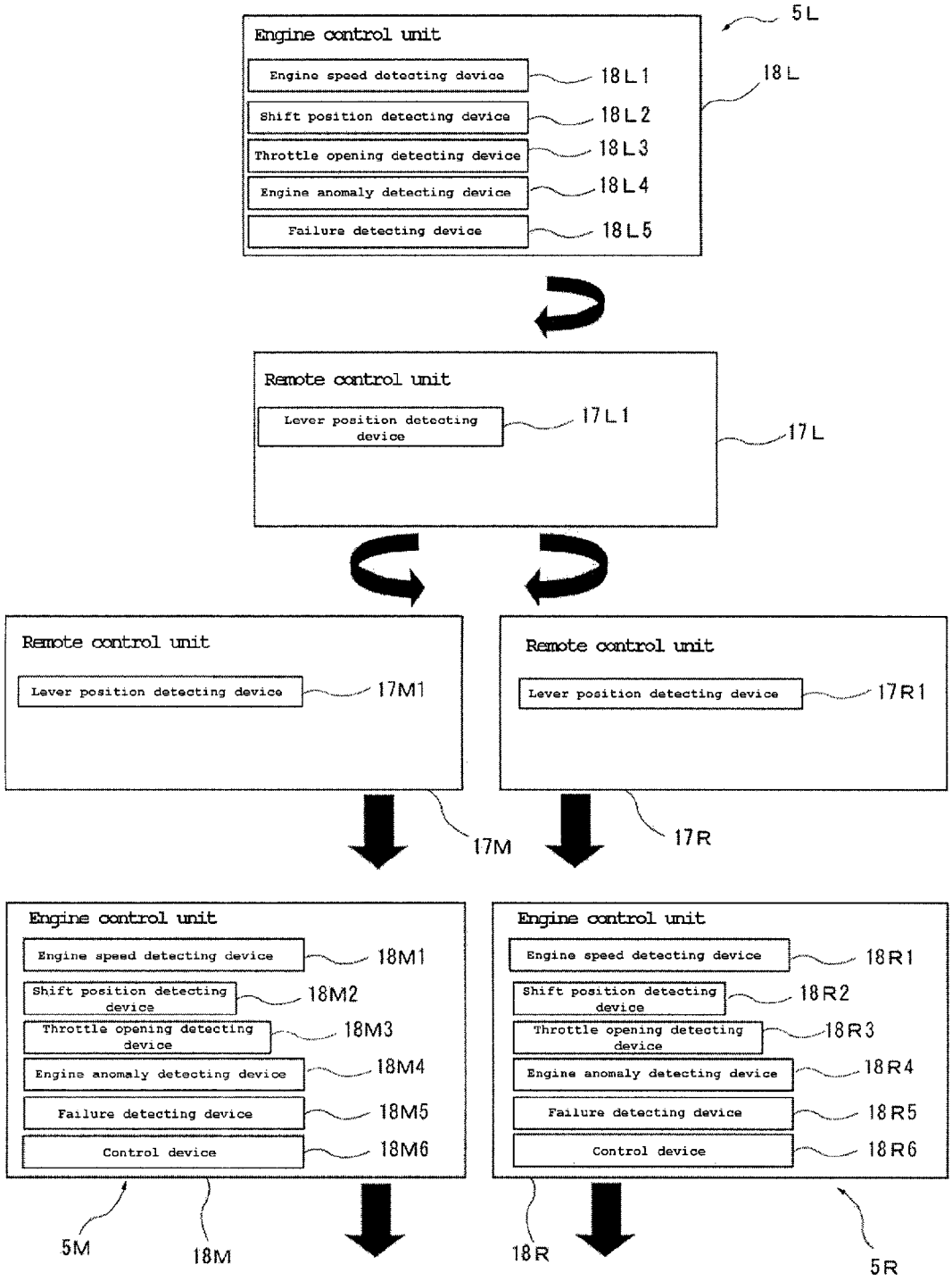
FIG. 5 is a block diagram of a configuration of a remote control unit and an engine control unit.
Figure 6:
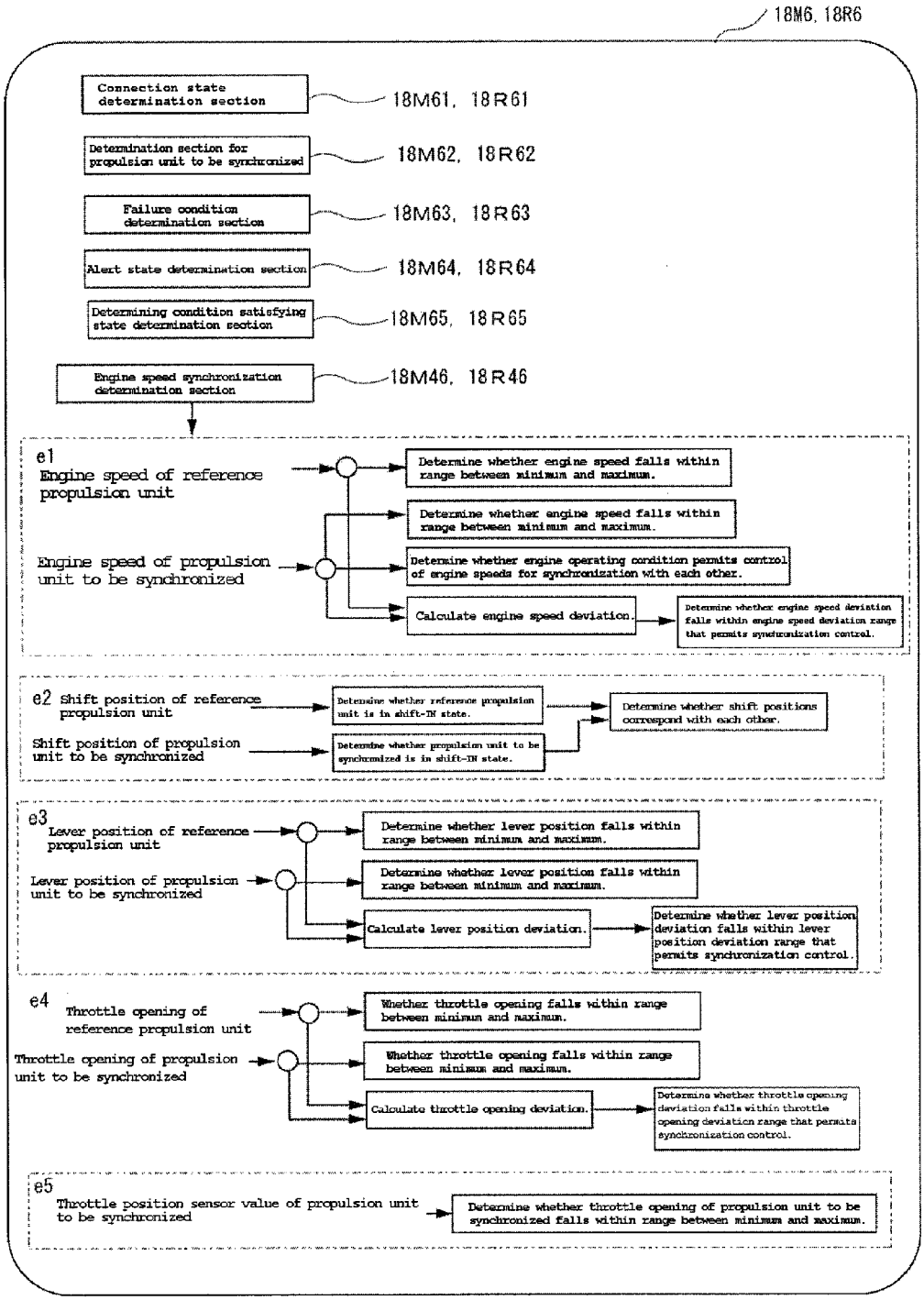
FIG. 6 illustrates one embodiment of a process to determine to enable engine speed synchronization control.
Figure 7:
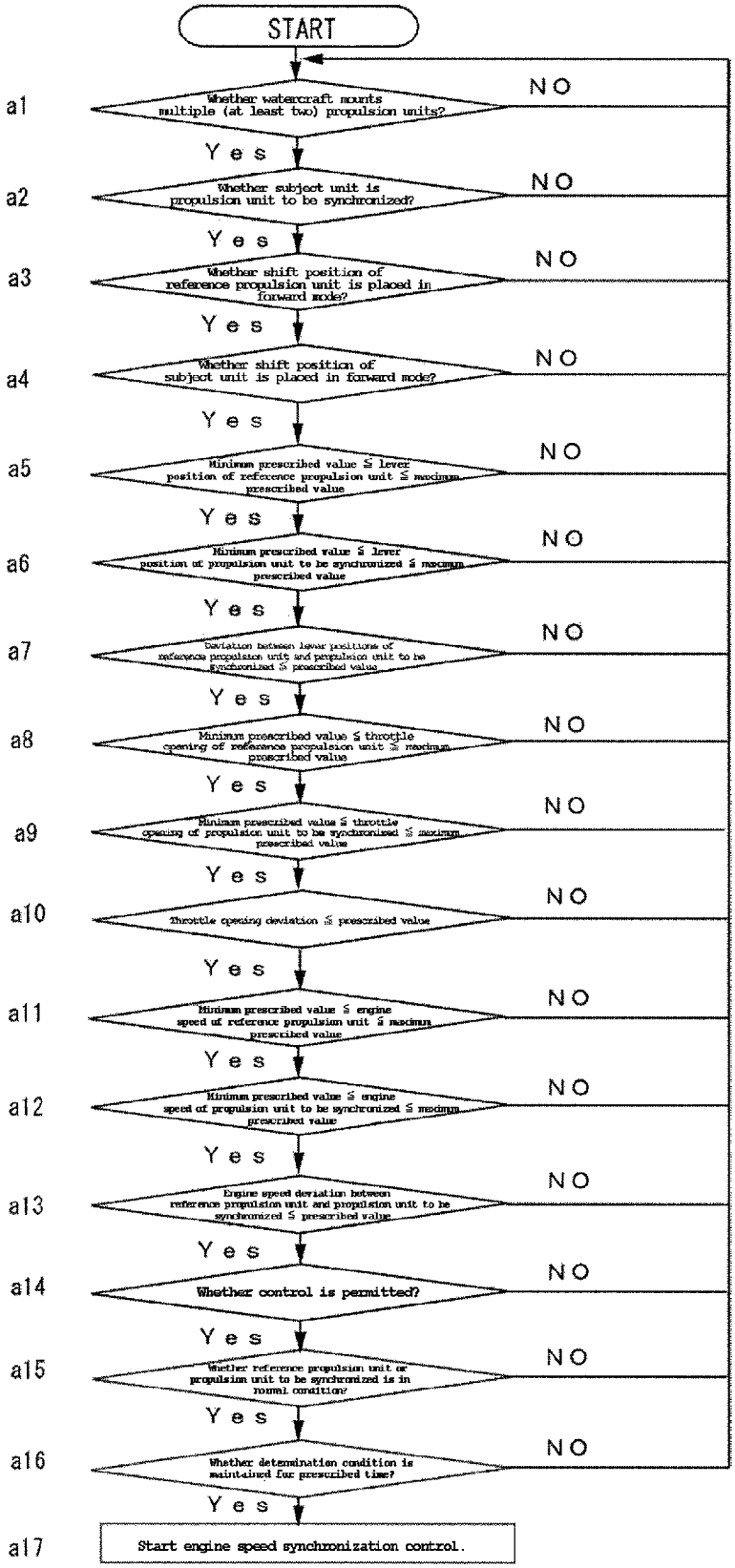
FIG. 7 is a flowchart to determine to implement the engine speed synchronization control.
Figure 8:
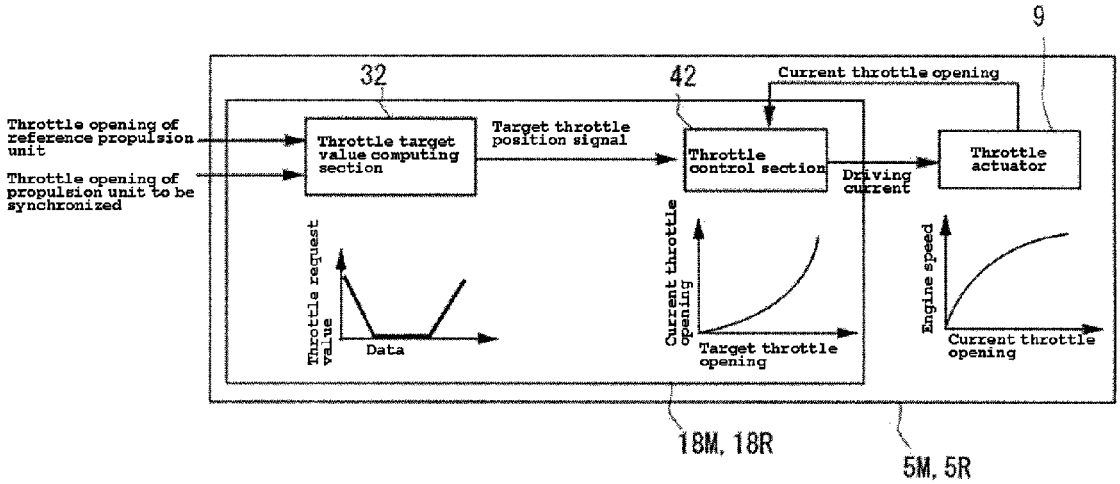
FIG. 8 is a block diagram illustrating a process of an engine speed synchronization control embodiment.

A process to control the engine speeds of the respective propulsion units for synchronization with each other will be hereinafter described with reference to FIGS. 4 to 8. FIG. 4 is a schematic block diagram of the propulsion unit control system. FIG. 5 is a block diagram of the configuration of the remote control unit and the engine control unit. FIG. 6 illustrates a process to determine to permit engine speed synchronization control. FIG. 7 is a flowchart to determine to implement the engine speed synchronization control. FIG. 8 is a block diagram illustrating a process of the engine speed synchronization control.

The illustrated propulsion unit control system is first described with reference to FIG. 4. The remote control unit 17L of the reference propulsion unit 5L receives a lever position sensor value from the lever position sensor 15L preferably as a voltage value. The remote control units 17M, 17R of the propulsion units 5M, 5R to be synchronized receive a lever position sensor value respectively from the lever position sensor 15R as a voltage value. The engine control unit 18L of the reference propulsion unit 5L receives a sensor value from the engine speed detecting sensor 70L as the number of pulses, and receives sensor values respectively from the shift position sensor 71L and the throttle position sensor 72L as a voltage value. The information obtained from the respective sensor values is sent to the remote control unit 17L, and then to the remote control units 17M, 17R.

The engine control units 18M, 18R of the propulsion units 5M, 5R to be synchronized preferably receive sensor values respectively from the engine speed detecting sensors 70M, 70R, the shift position sensors 71M, 71R, and the throttle position sensors 72M, 72R in the same manner as the engine control unit 18L. The engine control units 18M, 18R actuate the electronic throttle mechanisms 20M, 20R in accordance with the information obtained from the respective sensor values and the information sent to the remote control units 17M, 17R.

Now, the configuration of the remote control units 17L, 17M, 17R and the engine control units 18L, 18M, 18R is described with reference to FIG. 5. The remote control unit 17L of the reference propulsion unit 5L includes a lever position detecting device 17L1. The lever position detecting device 17L1 detects a lever position of the remote control lever 14L of the reference propulsion unit 5L based on the lever position sensor value. In the present embodiment, the lever position refers to an angle at which the lever is tilted forward or rearward from the neutral position.

The engine control unit 18L of the reference propulsion unit 5L includes an engine speed detecting device 18L1, a shift position detecting device 18L2, a throttle opening detecting device 18L3, an engine anomaly detecting device 18L4, and a failure detecting device 18L5. The engine speed detecting device 18L1 obtains an engine speed from the sensor value of the engine speed detecting sensor 70L. The shift position detecting device 18L2 obtains a shift position from the sensor value of the shift position sensor 71L. The throttle opening detecting device 18L3 obtains a throttle opening from the sensor value of the throttle position sensor 72L. The engine anomaly detecting device 18L4 detects an engine abnormal condition, such as overheating and low engine oil level of the engine 6 of the reference propulsion unit 5L, based on a sensor signal from the engine anomaly detecting sensor 73L of the reference propulsion unit 5L. The failure detecting device 18L5 detects a failure of the remote controller 13 of the boat or failures of the shift actuator and the throttle actuator of the left propulsion unit 5L based on a sensor signal from the failure detecting sensor 74L. The engine control unit 18L sends the remote control unit 17L information on the engine speed, the shift position, the throttle opening, the engine abnormal condition, and the failure of the reference propulsion unit 5L.

The remote control units 17M, 17R of the propulsion units 5M, 5R to be synchronized include lever position detecting devices 17M1, 17R1. The lever position detecting device 17R1 detects a lever position of the remote control lever 14R of the propulsion unit 5R to be synchronized. The propulsion unit 5R is controlled by operating the remote control lever 14R. The propulsion unit 5L is controlled by operating the remote control lever 14L. The propulsion unit 5M is controlled in accordance with an intermediate position between the remote control lever 14R and the remote control lever 14L. Therefore, the lever position detecting device 17M1 receives signals from the lever position sensor 15L and the lever position sensor 15R to control the propulsion unit 5M in accordance with an intermediate value between these signals. In the embodiment of the present invention, the lever position refers to an angle at which the lever is tilted forward or rearward from the neutral position. The remote control units 17M, 17R receive information on the lever angle, the shift position, the throttle opening, and the engine speed of the reference propulsion unit 5L from the remote control unit 17L.

The engine control units 18M, 18R of the propulsion units 5M, 5R to be synchronized include engine speed detecting devices 18M1, 18R1, shift position detecting devices 18M2, 18R2, throttle opening detecting devices 18M3, 18R3, engine anomaly detecting devices 18M4, 18R4, and failure detecting devices 18M5, 18R5. The engine speed detecting devices 18M1, 18R1 obtain an engine speed from the sensor values of the engine speed detecting sensors 70M, 70R. The shift position detecting devices 18M2, 18R2 obtain a shift position from the sensor values of the shift position sensors 71M, 71R. The throttle opening detecting devices 18M3, 18R3 obtain a throttle opening from the sensor values of the throttle position sensors 72M, 72R. The engine anomaly detecting devices 18M4, 18R4 detect an engine abnormal condition, such as overheating and low engine oil level of the engines 6 of the propulsion units 5M, 5R to be synchronized, based on respective sensor signals from the engine anomaly detecting sensors 73M, 73R of the propulsion units 5M, 5R to be synchronized. The failure detecting devices 18M5, 18R5 detect a failure of the remote controller 13 of the boat or failures of the shift actuator and the throttle actuator of the propulsion units 5M, 5R based on respective sensor signals from the failure detecting sensors 74M, 74R.

The engine control units 18M, 18R include control devices 18M6, 18R6. The control devices 18M6, 18R6 receive information on, for example, the lever position, the shift position, the throttle opening, and the engine speed of the reference propulsion unit 5L, as well as information on the engine speed, the shift position, and the throttle opening of the propulsion units 5M, 5R to be synchronized, in order to control the engine speeds of the respective propulsion units for synchronization with each other.

The configuration of preferred embodiments of the control devices 18M6, 18R6 are described with reference to FIG. 6. The control devices 18M6, 18R6 are configured in the same manner to determine the following items to control the engine speeds of the respective propulsion units for synchronization with each other.

Connection state determination sections 18M61, 18R61 determine whether the reference propulsion unit 5L is in a connection state based on the information on the lever position, the shift position, the throttle opening, and the engine speed of the reference propulsion unit 5L.

Determination sections for determining if a propulsion unit is to be synchronized 18M62, 18R62 determine whether the subject propulsion unit 5M or 5R is to be synchronized based on the information on the lever positions, the shift positions, the throttle openings, and the engine speeds of the propulsion units 5M, 5R to be synchronized.

Failure condition determination sections 18M63, 18R63 perform protection control based on a failure signal from the failure detecting device for detecting a failure of the boat or the respective propulsion units. In one preferred embodiment the protection control includes stopping the engine. Thus, the presence or absence of the protection control is defined as a determining condition to control the engine speeds for synchronization with each other. If no protection control is performed, the engine speeds of the respective propulsion units are controlled for synchronization with each other. In the event a failure occurs in the sensors and actuators of the control system included in the propulsion unit, the engine speed synchronization control cannot possibly be implemented. Thus, the presence or absence of the protection control performed by the control system of the plural propulsion units is defined as a determining condition to implement the engine speed synchronization control, thereby achieving the engine speed synchronization control in a stable manner.

Alert state determination sections 18M64, 18R64 perform alert control based on an anomaly signal from the engine anomaly detecting device for detecting an engine abnormal condition occurring in the respective propulsion units. The alert control includes decreasing the engine speed upon detection of an engine abnormal condition. The presence or absence of the alert control is defined as a determining condition to control the engine speeds for synchronization with each other. If the alert control is performed, the engine speeds of the respective propulsion units are not controlled for synchronization with each other.

As described above, the presence or absence of the alert control is defined as a determining condition to control the engine speeds for synchronization with each other, and if the alert control is performed, the engine speeds of the respective propulsion units are not controlled for synchronization with each other. Thereby, upon the alert to overheating or low hydraulic pressure, the engine speed is decreased in order to protect the engine. The engine is thus protected upon the alert by defining the presence or absence of the alert control as a determining condition to implement the engine speed synchronization control.

Determining condition satisfying state determination sections 18M65, 18R65 define a time, for which a determining condition is maintained, as a condition to implement the control of the engine speeds for synchronization with each other. When the determining condition is maintained for a prescribed time, the engine speeds of the respective propulsion units are controlled for synchronization with each other. In an environment that the propulsion units operate, a load condition varies depending on various requirements, such as wave and tidal current, which can cause the determining condition to be momentarily satisfied. Therefore, the time, for which the determining condition is maintained is defined as a condition to implement the control of the engine speeds for synchronization with each other. Thus, if the determining condition is maintained for a prescribed time, the engine speeds of the respective propulsion units are controlled for synchronization with each other. This allows the engine speed synchronization control to be achieved in a stable manner.

The condition to implement such control is established with the lever position of the remote control lever. If the remote control lever is placed at a prescribed position or a further position, the engine speeds of the respective propulsion units are controlled for synchronization with each other. It is conceivable that when a boat with plural propulsion units runs at low speed, the operator tends to frequently operate the remote control lever during cornering or turning, while when the boat runs in a cruising speed range, the operator often wants to match the engine speeds accurately as soon as possible. Therefore, in the case in which the boat runs at low engine speed with the lever positioned or tilted at a small angle (e.g. lever tilted angle: 10 to 20 degrees, engine speed: 3000 rpm), the prescribed time, for which the determining condition is maintained, as a determining condition is set longer. In the case in which the boat runs in a cruising speed range with the lever tilted at a large angle (e.g. lever tilted angle: 20 degrees or greater, engine speed: 3000 to 5000 rpm), the prescribed time, for which the determining condition is maintained, as a determining condition is set shorter. As described above, the condition to implement the control is established with the lever position of the remote control lever. If the remote control lever is placed at a prescribed position or a further position for the prescribed time, the engine speeds of the respective propulsion units are controlled for synchronization with each other. This achieves the engine speed synchronization control that matches the operator's intention.

Engine speed synchronization determination sections 18M46, 18R46 make a determination to synchronize the engine speeds of the respective propulsion units with each other in a manner described below.

In the step e1, it is determined whether the engine speed of the reference propulsion unit 5L falls within a range between a minimum engine speed and a maximum engine speed, and whether the engine speeds of the propulsion units 5M, 5R to be synchronized fall within a range between a minimum engine speed and a maximum engine speed. For example, the maximum engine speed is preset at 6000 rpm, and the minimum engine speed is preset at 500 rpm. In this way, an engine speed of any of the propulsion units is defined as a determining condition. If the engine speed is equal to or lower than the maximum engine speed, the control of the engine speeds of the respective propulsion units for synchronization with each other is permitted.

In addition, If an engine speed of any one of the propulsion units is equal to or higher than the minimum engine speed, the control of the engine speeds of the respective propulsion units for synchronization with each other is permitted.

Based on the engine speeds of the propulsion units 5M, 5R to be synchronized, it is determined whether or not the engine operates in a condition that permits the control of the engine speeds for synchronization with each other. If the determination is true, the control of the engine speeds of the respective propulsion units for synchronization with each other is permitted.

In addition, an engine speed deviation is calculated between the engine speed of the reference propulsion unit 5L and the engine speeds of the propulsion units 5M, 5R to be synchronized, in order to determine whether the engine speed deviation falls within an engine speed deviation range that permits the synchronization control. If the engine speed deviation falls within the engine speed deviation range, the control of the engine speeds of the respective propulsion units for synchronization with each other is permitted.

There is a case in which a maximum engine speed of each propulsion unit differs from one another due to variations in engine speed of the respective propulsion units or due to variations in load caused by the different locations of the propulsion units, and the reference propulsion unit can have the lowest maximum engine speed among the propulsion units. In this case, synchronizing the engine speeds of the propulsion units with the lowest engine speed of the reference propulsion unit results in a reduction in total output. Thus, in one embodiment an engine speed of any of the propulsion units is defined as a determining condition. If the engine speed is equal to or lower than the maximum engine speed, the engine speeds of the respective propulsion units are controlled for synchronization with each other. Defining the maximum engine speed for the engine speed synchronization control enhances total output of the propulsion units.

In addition, when controlling the engine with a small throttle opening, the engine speed is conventionally adjusted to an idle engine speed by throttle control and ignition timing control. Thus, in another embodiment, an engine speed of any one of propulsion units is defined as a determining condition, and if the engine speed is equal to or higher than the minimum engine speed, the engine speeds of the respective propulsion units are controlled for synchronization with each other. In order to avoid the idle engine speed control and the engine speed synchronization control from being simultaneously performed, the minimum engine speed for the engine speed synchronization control is defined to select appropriate control to the operating speed. This allows the engine rotations to be stabilized.

In the step e2, it is determined whether the reference propulsion unit 5L, is in a shift-in state based on the shift position of the remote control lever of the reference propulsion unit 5L, and whether the propulsion units 5M, 5R to be synchronized are in a shift-in state based on the shift position of the remote control lever of the propulsion units 5M, 5R to be synchronized. If the reference propulsion unit 5L and the propulsion units 5M, 5R to be synchronized are in a shift-in state, it is determined whether the shift position of the remote control lever of the reference propulsion unit 5L and the shift position of the remote control lever of the propulsion units 5M, 5R to be synchronized correspond with each other. In a preferred embodiment this is defined as a determining condition to control the engine speeds for synchronization with each other. If the shift positions correspond with each other, the control of the engine speeds of the respective propulsion units for synchronization with each other is permitted. In the plural propulsion units, when the shift positions do not correspond with each other, the load conditions differ from each other. This makes engine speed synchronization difficult, and does not meet the purpose of smooth cruising. Therefore, the corresponding shift positions preferably are defined as a determining condition to control the engine speeds for synchronization with each other. When the shift positions correspond with each other, the engine speeds of the respective propulsion units are controlled for synchronization with each other. This facilitates engine speed synchronization control that satisfies the operator's desire to match the engine speeds of the plural propulsion units.

In the step e3, a lever position deviation is computed between the lever position of the remote control lever of the reference propulsion unit 5L and the lever position of the remote control lever of the propulsion units 5M, 5R to be synchronized. The lever position deviation is defined as a determining condition. If the lever angle deviation is equal to or smaller than a prescribed value, the control of the engine speeds of the respective propulsion units for synchronization with each other is permitted. For example, in one embodiment a lever position deviation value or a lever angle deviation value is prescribed at five degrees. As described above, the lever position deviation is defined as a determining condition. When the lever position deviation is equal to or smaller than a prescribed value, it is determined that the remote control levers of the plural propulsion units are set to equally-angled positions, and the engine speeds of the respective propulsion units are controlled for synchronization with each other. This enables engine speed synchronization control that satisfies the operator's desire to match the engine speeds of the plural propulsion units.

In addition, in some embodiments it is determined whether the lever position of the remote control lever of the reference propulsion unit 5L falls within a range between a minimum position and a maximum position, and whether the lever position of the remote control lever of the propulsion units 5M, 5R to be synchronized falls within a range between a minimum position and a maximum position. This is defined as a determining condition to control the engine speeds for synchronization with each other, in order to permit the control of the engine speeds of the respective propulsion units for synchronization with each other.

In the step e4, a deviation is computed between the throttle opening of the reference propulsion unit 5L and the throttle openings of the propulsion units 5M, 5R to be synchronized. In a preferred embodiment the throttle opening deviation is defined as a determining condition. If the throttle opening deviation is equal to or smaller than a prescribed value, the control of the engine speeds of the respective propulsion units for synchronization with each other is permitted. In one example embodiment, a throttle opening deviation value is prescribed at five degrees. As described above, the throttle opening deviation value is defined as a determining condition to control the engine speeds for synchronization with each other. The throttle opening deviation is determined based on the throttle opening designed to adjust the air volume that decides the output of the propulsion unit. If the throttle opening deviation is equal to or smaller than the prescribed value, the engine speeds of the respective propulsion units are controlled for synchronization with each other. This enables engine speed synchronization control in a stable manner, under which the engine speeds of the plural propulsion units are synchronized with each other.

In addition, in some embodiments it is determined whether the throttle opening of the reference propulsion unit 5L falls within a range between a minimum throttle opening and a maximum throttle opening, and whether the throttle openings of the propulsion units 5M, 5R to be synchronized fall within a range between a minimum throttle opening and a maximum throttle opening. In such embodiments the throttle opening is defined as a determining condition to permit the control of the engine speeds of the respective propulsion units for synchronization with each other.

In the step e5 of the illustrated embodiment, it is determined whether the throttle openings, obtained from the throttle position sensor values of the propulsion units 5M, 5R to be synchronized, fall within a range between a minimum throttle opening and a maximum throttle opening. In this embodiment the throttle opening is defined as a determining condition to permit the control of the engine speeds of the respective propulsion units for synchronization with each other.

With next reference to FIG. 7, a flowchart is provided showing one embodiment of a process for determining whether to implement engine speed synchronization control.

In the step a1, the control devices 18M4, 18R4 of the propulsion units 5M, 5R to be synchronized determine whether the reference propulsion unit 5L is in a connection state based on the information on the lever position, the shift position, the throttle opening, and the engine speed of the reference propulsion unit 5L. The control devices 18M4, 18R4 then determine whether the boat mounts multiple (at least two) propulsion units.

In the step a2, if the boat mounts multiple (at least two) propulsion units, it is determined whether the subject unit is the propulsion unit 5M or 5R to be synchronized.

In the step a3, if the subject unit is the propulsion unit 5M or 5R to be synchronized with, it is determined whether the shift position of the reference propulsion unit 5L is placed in a forward mode.

In the step a4, if the shift position of the reference propulsion unit 5L is placed in a forward mode, it is determined whether the shift position of the propulsion unit 5M or 5R to be synchronized as the subject unit is placed in a forward mode.

In the step a5, if the shift position of the propulsion unit 5M or 5R to be synchronized as the subject unit is placed in a forward mode, it is determined whether the lever position of the reference propulsion unit 5L falls within a range between a minimum prescribed value and a maximum prescribed value.

In the step a6, if the lever position of the reference propulsion unit 5L falls within a range between a minimum prescribed value and a maximum prescribed value, it is determined whether the lever positions of the propulsion units 5M, 5R to be synchronized fall within a range between a minimum prescribed value and a maximum prescribed value.

In the step a7, if the lever position of the propulsion units 5M, 5R to be synchronized falls within a range between a minimum prescribed value and a maximum prescribed value, it is determined whether the lever position deviation is equal to or smaller than a prescribed value.

In the step a8, if the lever position deviation is equal to or smaller than a prescribed value, it is determined whether the throttle opening of the reference propulsion unit 5L falls within a range between a minimum prescribed value and a maximum prescribed value.

In the step a9, if the throttle opening of the reference propulsion unit 5L falls within a range between a minimum prescribed value and a maximum prescribed value, it is determined whether the throttle openings of the propulsion units 5M, 5R to be synchronized fall within a range between a minimum prescribed value and a maximum prescribed value.

In the step a10, if the throttle openings of the propulsion units 5M, 5R to be synchronized fall within a range between a minimum prescribed value and a maximum prescribed value, it is determined whether the throttle opening deviation is equal to or smaller than a prescribed value.

In the step a11, if the throttle opening deviation is equal to or smaller than a prescribed value, it is determined whether the engine speed of the reference propulsion unit 5L falls within a range between a minimum engine speed and a maximum engine speed.

In the step a12, if the engine speed of the reference propulsion unit 5L falls within a range between a minimum engine speed and a maximum engine speed, it is determined whether the engine speeds of the propulsion units 5M, 5R to be synchronized fall within a range between a minimum engine speed and a maximum engine speed.

In the step a13, if the engine speeds of the propulsion units 5M, 5R to be synchronized fall within a range between a minimum engine speed and a maximum engine speed, it is determined whether the engine speed deviation is equal to or smaller than a prescribed value.

In the step a14, if the engine speed deviation is equal to or smaller than a prescribed value, the presence or absence of the alert control in the respective propulsion units is defined as a determining condition. If the alert control is performed, the engine speeds of the respective propulsion units are not controlled for synchronization with each other.

The protection control is performed based on a failure signal from the failure detecting device for detecting a failure of the boat or the respective propulsion units. In the step a15, the presence or absence of the protection control is defined as a determining condition. If no protection control is performed, the engine speeds of the respective propulsion units are controlled for synchronization with each other.

In the step a16, the time, for which the determining condition is maintained, is defined as a condition to implement the control of the engine speeds for synchronization with each other. If the determining condition is maintained for a prescribed time, e.g. about two to three seconds in some embodiments, the engine speeds of the respective propulsion units are controlled for synchronization with each other.

In the step a17, when the determining condition is maintained for a prescribed time, the engine speeds of the respective propulsion units are controlled for synchronization with each other.

A process to control the engine speeds of the respective propulsion units for synchronization with each other will be hereinafter described with reference to FIG. 8, which is a block diagram illustrating a process of the engine synchronization control.

Referring now to FIG. 8, a discussion will be given to one embodiment for determining target shift and throttle positions for the engines of the propulsion units 5M, 5R to be synchronized. The engine control units 18M, 18R of the propulsion units 5M, 5R to be synchronized preferably include a throttle target value computing section 32 and a throttle control section 42. The throttle target value computing section 32 receives data on the throttle opening of the reference propulsion unit 5L and the throttle openings of the propulsion units 5M, 5R to be synchronized, and computes a throttle request value of the propulsion units 5M, 5R according to the data. The throttle target value computing section 32 then outputs a target throttle position signal. The throttle control section 42 compares information on a current throttle opening based on a signal fed back from the electronic throttle valve (i.e. motor 9) of the throttle actuator with the information on the target throttle opening inputted from the throttle target value computing section 32. The throttle control section 42 then outputs a target throttle opening signal so that the target throttle opening is achieved. As a result, an optimal amount of electric current is supplied to the throttle actuator so that the electronic throttle valve (i.e. motor 9) thereof is actuated to achieve the target throttle opening, thereby achieving a predetermined engine speed.

The embodiments discussed herein are applicable to a control system for a boat having plural propulsion units provided side by side, which synchronizes the engine speeds of the respective propulsion units with each other. These embodiments allow the engine speeds of the respective propulsion units to be controlled for synchronization with an operator's desired engine speed in consideration of variable operating environment and operating conditions.

Although certain preferred embodiments and examples have been disclosed, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A propulsion unit control system for a boat having plural propulsion units provided side by side and electrically connected in association with two adjacent operation levers that are controllable by an operator to operate a shift actuator and a throttle actuator of a corresponding one of the propulsion units, the control system comprising a lever position detecting device configured to detect a lever position of the operation lever associated with a reference propulsion unit and a lever position of the operation lever associated with a propulsion unit to be synchronized, a throttle opening detecting device configured to detect a throttle opening of the reference propulsion unit and a throttle opening of the propulsion unit to be synchronized, and a control device configured to control the engine speeds of the respective propulsion units for synchronization with each other when certain determining conditions are met, the control device being configured to compute a deviation between the lever position of the operation lever of the reference propulsion unit and the lever position of the operation lever of the propulsion unit to be synchronized and to compare the computed lever deviation to a prescribed value, the control device further configured to compute a deviation between the throttle opening of the reference propulsion unit and the throttle opening of the propulsion unit to be synchronized and to compare the computed throttle opening deviation to a prescribed value, and the control device is further configured to control the engine speeds of the propulsion units for synchronization with each other if the computed lever deviation and the computed throttle opening deviation are each equal to or smaller than their respective prescribed values.

2. The propulsion unit control system according to claim 1, wherein the control device is configured to define an engine speed of any one of the propulsion units as a determining condition, and if the engine speed is equal to or lower than a maximum engine speed, the control device controls the engine speeds of the respective propulsion units for synchronization with each other.

3. The propulsion unit control system according to claim 1, wherein the control device is configured to define an engine speed of any one of the propulsion units as a determining condition, and if the engine speed is equal to or higher than a minimum engine speed, the control device control the engine speeds of the respective propulsion units for synchronization with each other.

4. The propulsion unit control system according to claim 1, further comprising an engine anomaly detecting device configured to detect an engine abnormal condition of the respective propulsion units, wherein the control device is configured to perform alert control based on detection of the engine abnormal condition, and wherein the presence or absence of the alert control is a determining condition so that, if the alert control is performed, the control device will not control the engine speeds of the respective propulsion units for synchronization with each other.

5. The propulsion unit control system according to claim 1, further comprising a failure detecting device for detecting a failure of the boat or the respective propulsion units, wherein the control device is configured to perform protection control based on detection of the failure, and wherein the presence or absence of the protection control is a determining condition so that, if no protection control is performed, the control device will control the engine speeds of the respective propulsion units for synchronization with each other.

6. The propulsion unit control system according to claim 1, further comprising a shift position detecting device configured to detect a shift position of the operation lever of the reference propulsion unit and a shift position of the operation lever of the propulsion unit to be synchronized, wherein whether the shift position of the operation lever of the reference propulsion unit and the shift position of the operation lever of the propulsion unit to be synchronized correspond with each other is a determining condition, and the control device is configured so that if the shift positions correspond with each other, the control device will control the engine speeds of the respective propulsion units for synchronization with each other.

7. The propulsion unit control system according to claim 1, wherein the control device defines a prescribed time, and the control device is configured so that if the determining conditions are maintained for the prescribed time, the control device will control the engine speeds of the respective propulsion units for synchronization with each other.

8. The propulsion unit control system according to claim 1, wherein the control device is configured to be actuated when the operation lever is placed at a prescribed position or a further position.

9. A method for controlling a plurality of propulsion units that are mounted side by side on a boat and are electrically connected with two adjacent operation levers that are controllable by an operator to operate a shift actuator and a throttle actuator of a corresponding one of the propulsion units, the method comprising providing a lever position detecting device, detecting a lever position of the operation lever associated with a reference propulsion unit, detecting a lever position of the operation lever associated with a propulsion unit to be synchronized, providing a throttle opening detecting device, detecting a throttle opening of the reference propulsion unit, detecting a throttle opening of the propulsion unit to be synchronized, providing a control device configured to selectively control the engine speeds of the respective propulsion units for synchronization with each other, determining whether at least a first and a second determining condition are met, and controlling the engine speeds of the propulsion units for synchronization with each other if the control device determines that the determining conditions are met, wherein determining whether the first determining condition is met comprises computing a deviation between the lever position of the operation lever of the reference propulsion unit and the lever position of the operation lever of the propulsion unit to be synchronized and comparing the computed lever deviation to a prescribed value, and if the computed lever deviation is equal to or less than the prescribed value the first determining condition is met, and wherein determining whether the second determining condition is met comprises computing a deviation between the throttle opening of the reference propulsion unit and the throttle opening of the propulsion unit to be synchronized and comparing the computed throttle opening deviation to a prescribed value, and wherein if computed throttle opening deviation is equal to or less than the associated prescribed value then the second determining condition is met.

10. The method of claim 9 additionally comprising determining whether the engine speed is equal to or lower than a maximum engine speed, and if the engine speed is equal to or lower than a maximum engine speed the control device controls the engine speeds of the respective propulsion units for synchronization with each other.

11. The method of claim 10 additionally comprising defining an engine speed of any one of the propulsion units as a determining condition, and if the engine speed is equal to or higher than a minimum engine speed, controlling the engine speeds of the respective propulsion units for synchronization with each other.

12. The method of claim 11 further comprising providing an engine anomaly detecting device, and if the engine anomaly detection device detects an anomaly, terminating any control of the engine speeds of the respective propulsion units for synchronization with each other.

13. The method of claim 12 further comprising providing a failure detecting device for detecting a failure of the boat or the respective propulsion units, and if no failure is detected, controlling control the engine speeds of the respective propulsion units for synchronization with each other.

14. The method of claim 11 further comprising providing a shift position detecting device configured to detect a shift position of the operation lever of the reference propulsion unit and a shift position of the operation lever of the propulsion unit to be synchronized, and if the shift position of the operation lever of the reference propulsion unit and the shift position of the operation lever of the propulsion unit to be synchronized correspond with each other, controlling the engine speeds of the respective propulsion units for synchronization with each other.

15. The method of claim 9, wherein if the determining conditions are maintained for the prescribed time, controlling the engine speeds of the respective propulsion units for synchronization with each other.

* * * * *